US005772045A

United States Patent [19]

Zanarini

[11] Patent Number: 5,772,045

[45] Date of Patent: Jun. 30, 1998

[54] SELECTOR FOR BADLY-FILLED CAPSULES

[75] Inventor: Bruno Zanarini, San Lazzaro di Savena, Italy

[73] Assignee: Macofar S.p.A., Pianoro, Italy

[21] Appl. No.: 602,025

[22] Filed: Feb. 15, 1996

[30] Foreign Application Priority Data

Feb. 16, 1995 [IT] Italy ..... BO95A0055

[51] Int. Cl.[6] ..... B07C 5/00

[52] U.S. Cl. ..... 209/643; 209/645; 209/139.1; 209/150

[58] Field of Search ..... 209/138, 139.1, 209/591, 592, 643–645, 150

[56] References Cited

U.S. PATENT DOCUMENTS

| | | | |
|---|---|---|---|
| 3,097,161 | 7/1963 | Dudyak | 209/645 X |
| 3,738,485 | 6/1973 | Garland | 209/643 |
| 3,904,515 | 9/1975 | Mackenzie et al. | 209/138 X |
| 3,997,058 | 12/1976 | Greer et al. | 209/643 X |
| 4,191,294 | 3/1980 | McGrath, Jr. et al. | 209/592 X |
| 5,040,353 | 8/1991 | Evans et al. | 209/644 X |

FOREIGN PATENT DOCUMENTS

| | | | |
|---|---|---|---|
| 2260893 | 12/1972 | Germany | 209/138 |

*Primary Examiner*—Boris Milef
*Attorney, Agent, or Firm*—Oblon, Spivak, McClelland, Maier & Neustadt, P.C.

[57] ABSTRACT

The selector for badly-filled capsules consists of a constantly rotating ring-shaped capsule transfer plate which has an infeed for the capsules to be selected and an outfeed for the selected capsules, above which a substantially vertical suction mouth is fitted, being of the compressed air type with Venturi effect in the constricted tube, designed to suck up those capsules whose weight is below a preset value, the suction pressure being adjustable by means of the compressed air supply in the mouth.

2 Claims, 4 Drawing Sheets

21
1
23
22
9a
8
17
24
9
12
13
11
6
7
3
3
2
5
4

SELECTOR FOR BADLY-FILLED CAPSULES

BACKGROUND OF THE INVENTION

The present invention relates to a selector for badly-filled capsules, to be fitted at the outfeed of a capsule filling machine.

It is known that at the outfeed of a capsule filling machine (machine designed to fill small capsules with powdered products, mainly medicinal, then close them) some capsules are badly filled and must be eliminated: the present invention relates to a selector for badly-filled capsules which effects a selection by eliminating those capsules which are empty or only partially filled with the content envisaged: if necessary, a more precise selection is effected using other total control devices (check-weighers) upstream of the final packaging machines.

The known selection machines normally operate using either a direct air jet from fans onto the capsule in transit or with vibrating surfaces: in the first case the capsules are inopportunely subjected to hot air which may contain impurities, whilst in the second case problems of selection may arise relative to the distribution of the capsules on the vibrating lane.

The technical aim of the present invention is to overcome the afore-mentioned disadvantages of the known devices, that is to say, to perfect a selector for badly-filled capsules in which the capsules are not subjected to hot air and there are no vibrating lanes.

A further aim of the present invention, is to fulfill the said technical aim with a simple structure, relatively easy to implement, safe and efficient, as well as economical.

SUMMARY OF THE INVENTION

The said aims are fulfilled by the selector for badly-filled capsules characterized in that it consists of a constantly rotating ring-shaped plate for capsule transfer, with an infeed for the capsules to be selected and an outfeed for the selected capsules, above which a substantially vertical suction mouth is fitted, being of the compressed air type with Venturi effect in the constricted tube, designed to suck up those capsules whose weight is below a preset value, the suction pressure being adjustable by means of the compressed air supply in the mouth.

BRIEF DESCRIPTION OF THE DRAWINGS

The technical features of the present invention, in accordance with the aforesaid aims, are clearly illustrated in the claims herein, and the advantages of the said features are more clearly described in the detailed description below, with reference to the accompanying drawings, which illustrate an embodiment of the selector for badly-filled capsules by way of example only, and in which:

DESCRIPTION OF THE PREFERRED EMBODIMENTS

Figure 1:
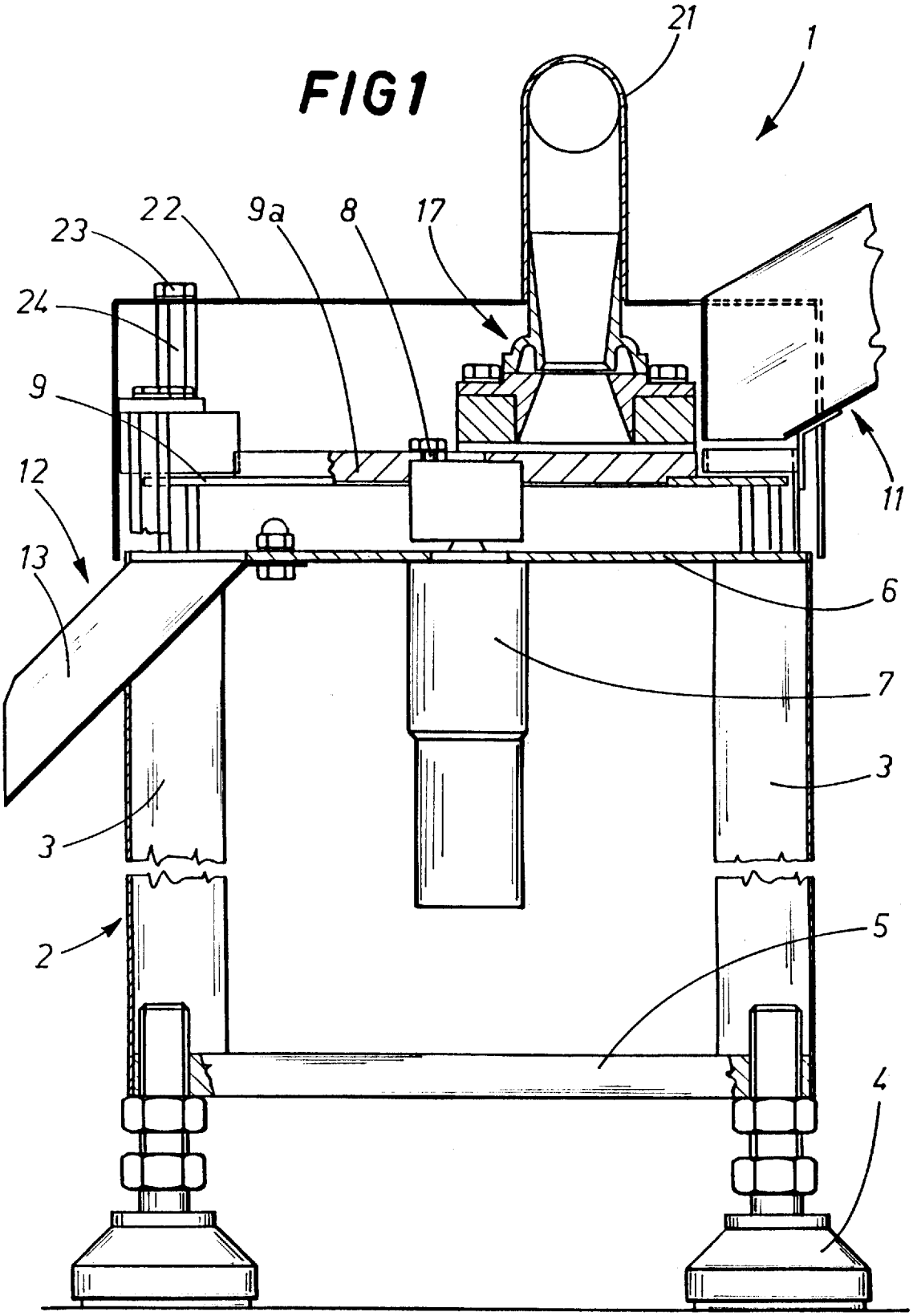
FIG. 1 is a front view, partly shown in cross-section along a median plane, of a selector for badly-filled capsules disclosed.

With reference to the accompanying drawings, the selector for badly-filled capsules disclosed is indicated as a whole by the numeral 1.

The selector 1 includes a vertical parallelepiped support frame consisting of four legs 3 with respective feet 4 at an adjustable distance from the ground, and of four vertical external panels: there is a base 5 at the bottom of the frame and a cover surface 6 at the top.

Below the center of the surface 6, a geared motor unit 7 is attached to the vertical axis constantly rotating in the direction of the arrow A to whose central shaft a plate 9 is fixed by screws 8: a disc 9*a* rises at the center of the plate 9, said disc defining a ring-shaped rotating plate for capsule transfer: the ring-shaped plate is enclosed in a fixed external peripheral ring 10.

Above the plate 9 is a fixed infeed 11 for the capsules to be selected, consisting of a chute with U-shaped cross-section: at another point on the surface 6 there is an outlet 12 for the selected capsules, consisting of a chute 13 with substantially U-shaped cross-section, its inlet being coplanar with and joined to the surface of the ring-shaped plate 9: when the ring-shaped plate 9 rotates, the capsules are pushed to the inlet of the chute 13 by a fixed vertical blade 14 which may be angled by adjusting a threaded shank-nut 15 at the end of an arm 16 fixed to the surface 6 with a screw-nut.

Above the section of the ring-shaped plate between the infeed 11 and outlet 12, a substantially vertical suction mouth 17 is fixed to the surface 6: the mouth 17 is of the known compressed air type (shown schematically with black arrows B), the compressed air supplied through a transversal tube 18 at the constriction 19 in a flared truncated cone tube 20: the Venturi effect generates a strong suction flow (in the direction of the light arrows B) designed to suck those capsules whose weight is below a preset value from the ring-shaped plate 9.

The suction pressure in the tube 20 can be adjusted by means of the compressed air supply in the tube 18 which, advantageously, may be controlled by a proportional solenoid valve, or a mechanical valve (said valves not illustrated in the figures).

Figure 2A:
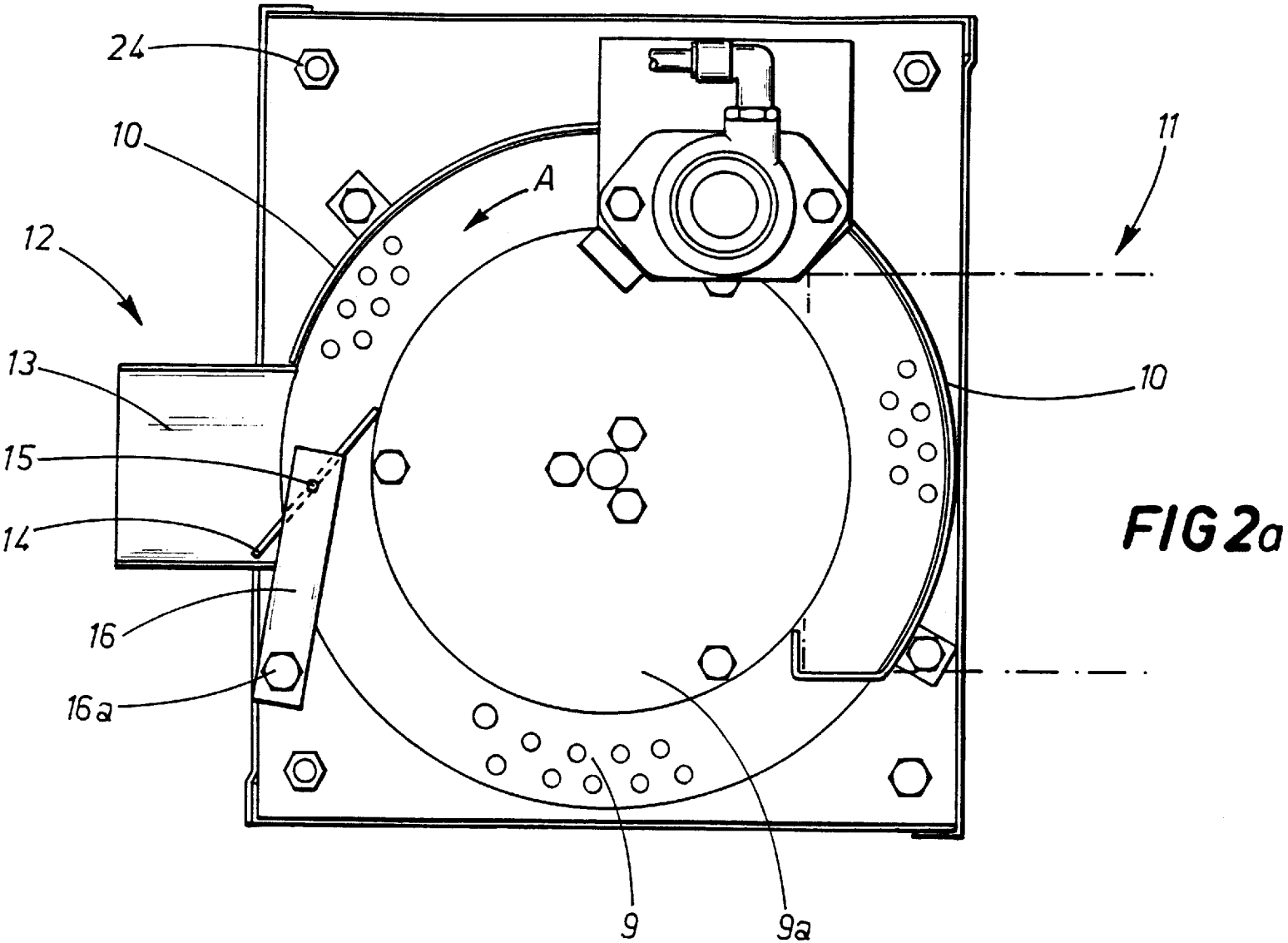
FIG. 2*a* is a plan view similar to FIG. 2 showing an alternate embodiment of the invention.
Figure 2B:
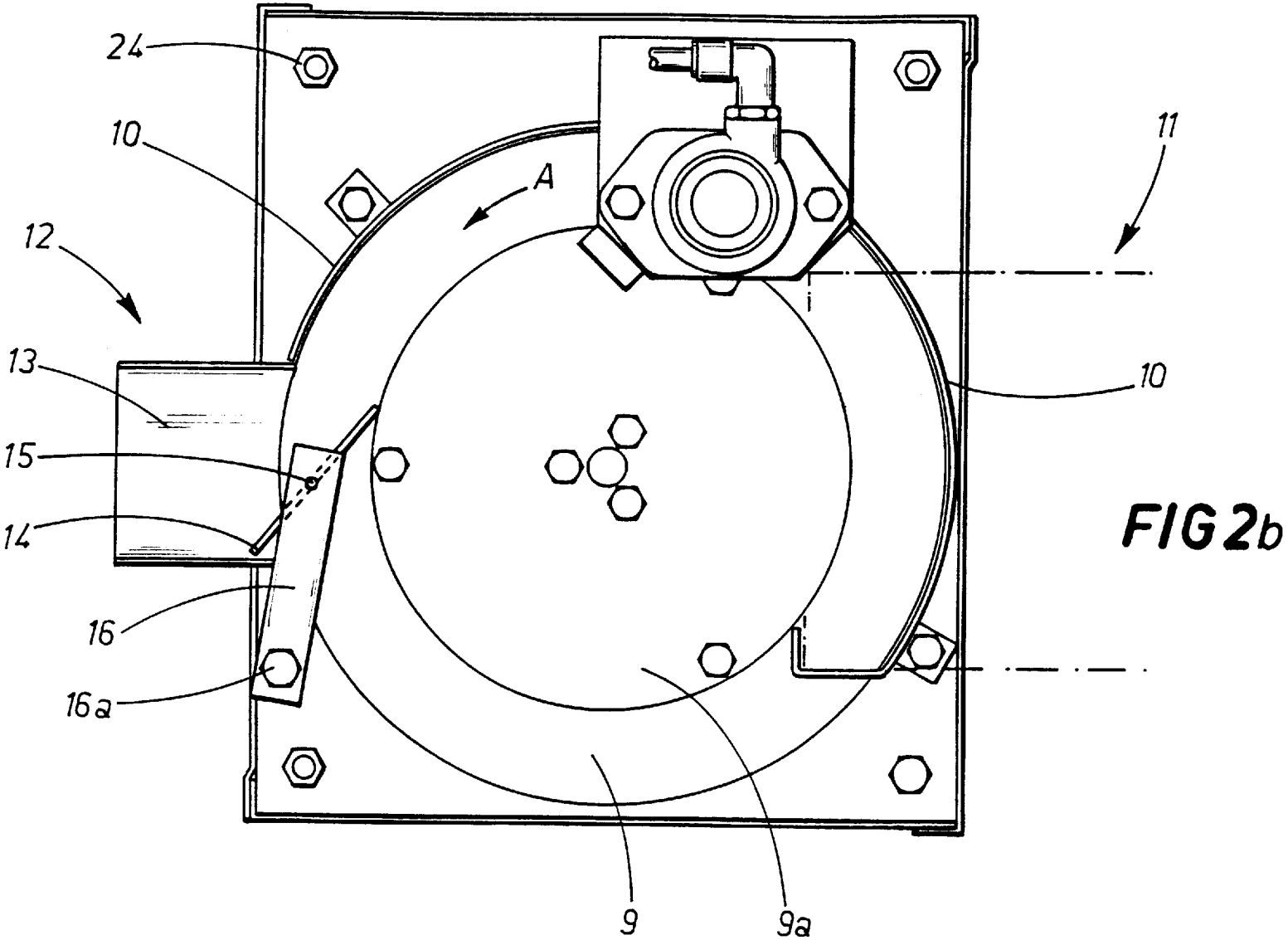
FIG. 2 is a plan view of the selector for badly-filled capsules in FIG. 1 with the protective cover removed.
Figure 3:
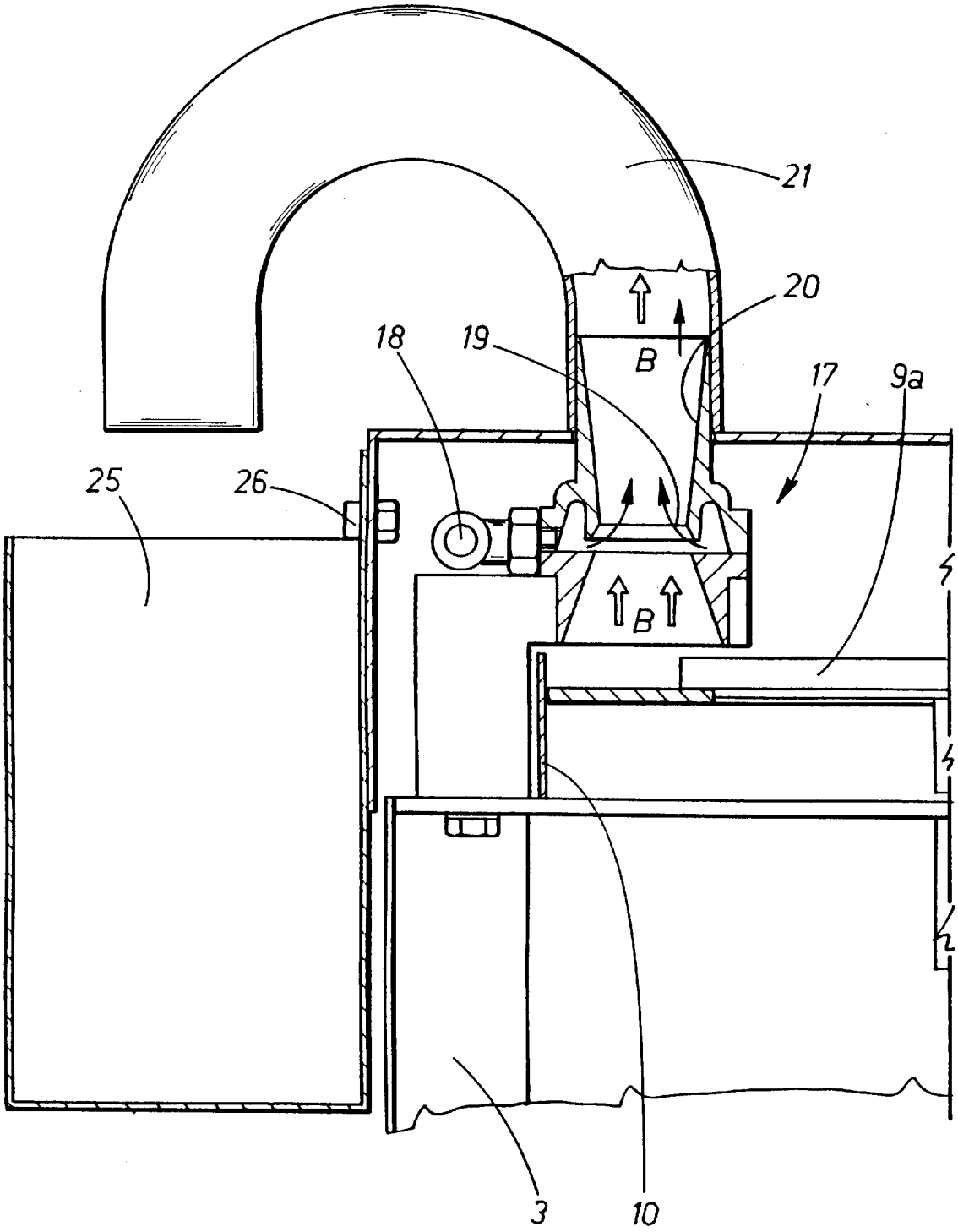
FIG. 3 is a side view, partially shown in cross-section, of a detail of the selector.

The tube 20 is connected to the infeed of a tubular flue 21, bent into the shape of an inverted U, for the discharge of the badly-filled capsules. In a possible operating version shown in FIG. 2A, the surface of the ring-shaped plate 9' may be perforated to allow improved passage of the air flow for capsule suction and to improve the efficiency of the separator, if necessary, also relative to capsule shape and/or weight.

A shaped protective cover 22 is fitted over the surface 6 and secured by bolts 23 with four small columns 24 which extend from the corners of the surface: the numeral 25 indicates a container for the collection of defective capsules, fixed to the protective cover 22 by a bolt 26.

Notice that the air flow for badly-filled capsule pick-up, being a suction flow, avoids the use of a hot air jet, which may be polluted, on the capsules: the badly-filled capsules are removed in an extremely well distributed flow, and the selection of which capsules to leave and which to remove is quite precise: in operation, a selector of the type disclosed is able to remove and carry away capsules filled with a high percentage and very little less than the preset content.

The present invention, therefore, fulfills the afore-mentioned aims.

The present invention, thus designed for the said objects, may be subject to numerous variations, all encompassed by the original design concept, and all components may be substituted with technically equivalent parts.

The materials used, the shapes and sizes may vary according to use, but are all encompassed by the following claims.

What is claimed:

1. A selector for badly-filled capsules, comprising:

a constantly rotating ring-shaped plate for capsule transfer, having an infeed for the capsules to be selected and an outfeed for the selected capsules;

a compressed air supply;

a substantially vertical suction mouth above said plate and designed to suck up capsules having a weight lower than a preset value, said mouth including a constricted tube operatively connected to said compressed air supply to generate a Venturi effect in the constricted tube, the suction pressure being adjustable by the compressed air supply.

2. The selector as described in claim 1, characterized in that the surface of the rotating ring-shaped plate is perforated, so as to distribute the air flow for capsule suction.

* * * * *